US006273157B1

(12) United States Patent
Molnar

(10) Patent No.: US 6,273,157 B1
(45) **Date of Patent: *Aug. 14, 2001**

(54) GASOLINE PUMP HANDLE HOLD-OPEN DEVICE

(76) Inventor: George J. Molnar, 29 Furnace St., Norfolk, NY (US) 13667

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/388,689

(22) Filed: Sep. 2, 1999

Related U.S. Application Data

(60) Provisional application No. 60/099,309, filed on Sep. 3, 1998.

(51) Int. Cl.[7] ..... B65B 1/04; B65B 3/00; B67C 3/00

(52) U.S. Cl. ..... 141/392; 141/218; 251/90

(58) Field of Search ..... 251/90, 92, 93; 141/206, 218, 392; 74/526; D8/349

(56) References Cited

U.S. PATENT DOCUMENTS

| | | | | |
|---|---|---|---|---|
| D. 312,172 | * | 11/1990 | Ambrosio | D3/62 |
| D. 332,046 | * | 12/1992 | Isett | D8/349 |
| 4,175,595 | * | 11/1979 | Noe | 141/1 |
| 4,275,776 | * | 6/1981 | Rehkopf | 141/392 |
| 4,278,116 | * | 7/1981 | Opp | 141/392 |
| 4,592,530 | | 6/1986 | Seely et al. . | |
| 4,683,923 | | 8/1987 | Harris . | |
| 4,690,182 | | 9/1987 | Knaus . | |
| 4,846,447 | | 7/1989 | Hanna . | |
| 5,199,474 | | 4/1993 | D'Angelo . | |
| 5,217,054 | | 6/1993 | Mollica . | |
| 5,238,036 | | 8/1993 | Bunce . | |
| 5,377,729 | | 1/1995 | Reep . | |
| 5,595,367 | | 1/1997 | Sternes et al. . | |
| 6,070,625 | * | 6/2000 | Robinson et al. | 141/392 |

* cited by examiner

*Primary Examiner*—Timothy L. Maust
(74) *Attorney, Agent, or Firm*—Standley & Gilcrest LLP

(57) ABSTRACT

A hold-open device comprising a small block that can easily be inserted into a pump handle, thereby holding the handle in the open position. A center hole provides for easy removal of the device when pumping is complete. Removal may be facilitated by simply placing one finger into the hole and sliding the device free of the pump handle. A finger-like protrusion at one corner of the block prevents the device from slipping out of the pump handle during operation.

7 Claims, 1 Drawing Sheet

GASOLINE PUMP HANDLE HOLD-OPEN DEVICE

This application claims the benefit of U.S. Provisional Application No. 60/099,309, filed Sep. 3, 1998.

BACKGROUND AND SUMMARY OF INVENTION

The present invention relates generally to gasoline pump dispensing handle assemblies, and more specifically to a device for holding a pump handle assembly in the open or operating position for the hands-free dispensing of gasoline.

Many conventional gasoline dispensing handle assemblies include automatic shut-off valves which stop the flow of gasoline once the tank being filled is full of gasoline. Generally, these pump handles include a clip which allows the user to prop the trigger in the open position so that the customer does not have to hold the handle during fueling. Such a mechanism allows the customer to do other things, such as clean the windshield of the vehicle and check the oil during the fueling process. Such a device also helps to prevent customer contact with gasoline should the shut-off valve malfunction and overfill the tank.

In many self-serve gas stations, however, such a trigger propping mechanism is not provided by the pump manufacturer or has been removed from the pump handles. The present invention is a compact, lightweight, portable device for holding pump handles open during the fueling process. A customer at a self-service gas station lacking such built-in devices can use the present invention to provide hands-free fueling.

A number of devices to maintain a pump handle in the open position during fueling have been suggested, including the devices shown and described in prior U.S. Pat. Nos. 4,683,923; 4,690,182; 5,199,474; 5,217,054; and 5,595,367. In many cases, however, these devices may be expensive, complicated to use, and unstable during operation. Some prior inventions require the customer to align the handle with one of several grooves in the device, making its use a tedious task and often leading to failure of the device during its operation due to slippage.

The present invention overcomes the disadvantages of the known art and provides a simple, lightweight, inexpensive, yet effective method for holding the handle of a gasoline pump in the open position during fueling.

The present invention preferably incorporates a small block composed of a lightweight material, such as plastic, that can be easily inserted into the pump handle to hold the handle in the open position. The simple design of the present invention also provides for a more stable fit than that provided by the prior art, thus decreasing the possibility that the device might slip free from its operating position. A center hole allows the customer to easily remove the device when fueling is complete, by simply placing one finger into the hole and sliding the device free of the pump handle.

BRIEF DESCRIPTION OF DRAWINGS

In addition to the novel features and advantages mentioned above, other objects and advantages of the present invention will be readily apparent from the following descriptions of the drawings and preferred embodiments, wherein.

DETAILED DESCRIPTION OF THE PREFERRED EMBODIMENT(S)

Figure 1:
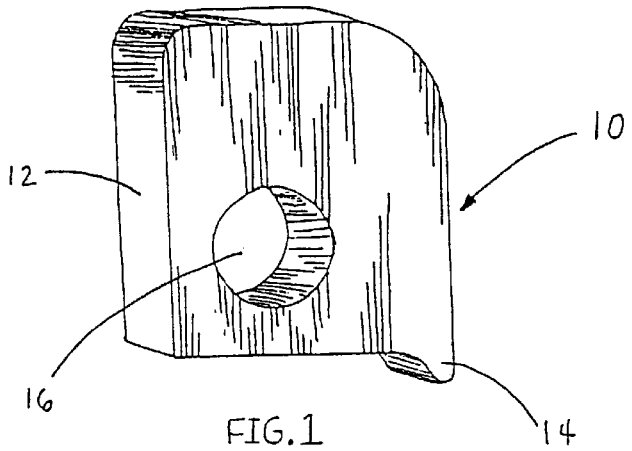
FIG. 1 is a perspective view of a preferred embodiment of the present invention.

Referring FIG. 1, there is shown a preferred embodiment of a pump handle hold-open device 10 of the present invention. The hold-open device 10 comprises a block body 12, a retaining finger 14 and a removal hole 16.

Figure 2:
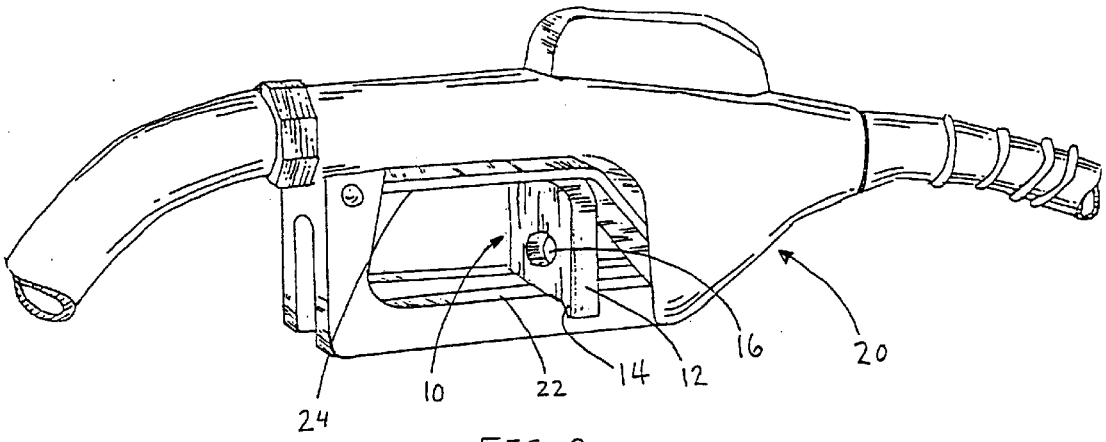
FIG. 2 is a perspective view of a preferred embodiment of the present invention, holding a pump handle in a fully open position.

The block body 12 is preferably generally rectangular in shape. As shown in FIG. 2, the height of block body 12 is preferably approximately 2.5 inches, and is slightly less than the distance between the base 22 and the lever 24 of the pump handle 20, when the pump handle is in its fully open position This allows the hold-open device 10 to be inserted in an upright position, thereby holding lever 24 in its fully open position.

Figure 3:
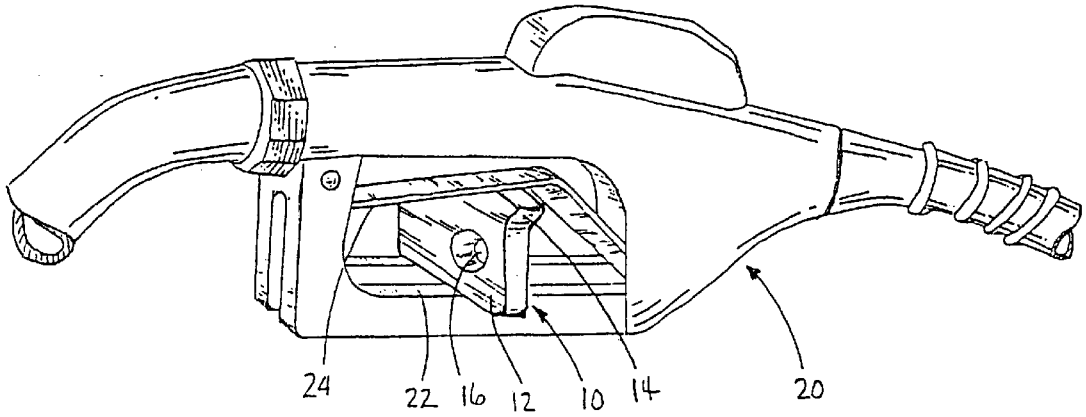
FIG. 3 is a perspective view of a preferred embodiment of the present invention holding a pump handle in a partially open position.

Referring now to FIG. 3, the width of block body 12 is preferably somewhat less than its height, allowing the hold-open device 10 to be inserted in a sideways position into pump handle 20. Sideways insertion of the hold-open device 10 will maintain lever 24 in a position that is less than fully open, should the user desire a slower dispensing rate.

In a preferred embodiment of the present invention, the retaining finger 14 extends from one corner of the block body 12, so that when device 10 is used in its upright position as shown in FIG. 2, it is kept from sliding completely through pump handle 20. Retaining finger 14, in conjunction with the depth of the block body 12, helps keep the hold-open device 10 stable during use.

A removal hole 16 is also preferably provided and may be located near the center of the block body 12. The removal hole 16 should preferably be large enough to accommodate the finger of a user, allowing the user to insert a finger into the removal hole and slide the hold-open device 10 free of handle 20.

The scope of the invention is not to be considered limited by the above disclosure, and modifications are possible without departing from the spirit of the invention as evidenced by the following claims.

What is claimed is:

1. A device for maintaining the valve of a pump handle in an open position, said device consisting essentially of:

a block consisting essentially of four substantially smooth, flat side portions, said side portions interconnected by four corners such that each of said side portions is substantially parallel to a respective opposing one of said side portions;

a retaining finger protruding from one of said corners of said block; and the other three of said corners of said block selected from the group consisting of radiused corners and 90-degree angle corners;

wherein said block is adapted to be slid transversely into and out of position between a base and a lever of said pump handle substantially without rotating said block; and said retaining finger is adapted to abut said pump handle when said block is slid transversely into position.

2. The device of claim 1, wherein said block consists of a non-metallic material.

3. The device of claim 2, wherein said block is approximately 2½ inches in height, approximately 1⅞ inches in width, and approximately ½ inch thick.

4. The device of claim 1, wherein said pump handle is used for dispensing gasoline.

5. The device of claim 1, wherein said pump handle is used for dispensing diesel fuel.

6. The device of claim 1 wherein said block is generally rectangular.

7. The device of claim 1 further consisting essentially of a hole through said block, said hole adapted to accommodate a finger of a user to facilitate removal of said device from said pump handle.

* * * * *